US005848792A

United States Patent [19]

Brejcha

[11] Patent Number: 5,848,792

[45] Date of Patent: Dec. 15, 1998

[54] TARGET CONSTRUCTION

[75] Inventor: Robert J. Brejcha, South Elgin, Ill.

[73] Assignee: Valley Recreation Products Inc., Bay City, Mich.

[21] Appl. No.: 869,350

[22] Filed: Jun. 5, 1997

[51] Int. Cl.[6] ..... F41D 3/00

[52] U.S. Cl. ..... 273/376

[58] Field of Search ..... 273/374, 376

[56] References Cited

U.S. PATENT DOCUMENTS

| | | | |
|---|---|---|---|
| 4,586,716 | 5/1986 | Brejcha et al. | 273/376 |
| 4,836,556 | 6/1989 | DeVale et al. | 273/376 |
| 5,482,291 | 1/1996 | Houriet, Jr. et al. | 273/376 |
| 5,626,344 | 5/1997 | Huang | 273/376 |
| 5,718,433 | 2/1998 | Lu et al. . | |

FOREIGN PATENT DOCUMENTS 2014321 8/1996 United Kingdom .

OTHER PUBLICATIONS

French Bulletin Des Bessins et Models Internationaux—Aug. 1994.

Harrows Ltd. Product Profile titled Quadro 240—1992.

*Primary Examiner*—William H. Grieb

*Attorney, Agent, or Firm*—Reising, Ethington, Learman & McCulloch PLLC

[57] ABSTRACT

A target for use with darts, for example, has a base on which a target frame is secured, the frame having a plurality of spaces within each of which is a segment that is movable toward the base when it is struck by a thrown dart. Corresponding ones of the segments have cavities therein for the accommodation of inserts which are movable independently of the segment toward the target base when such inserts are struck by a thrown dart. The inserts are so arranged that, together, they form an annulus or ring of individually displaceable components. Interposed between the target base and the target segments and inserts are switches and a resilient biasing pad which bias the segments to an initial, at rest position.

20 Claims, 3 Drawing Sheets

FIG-1
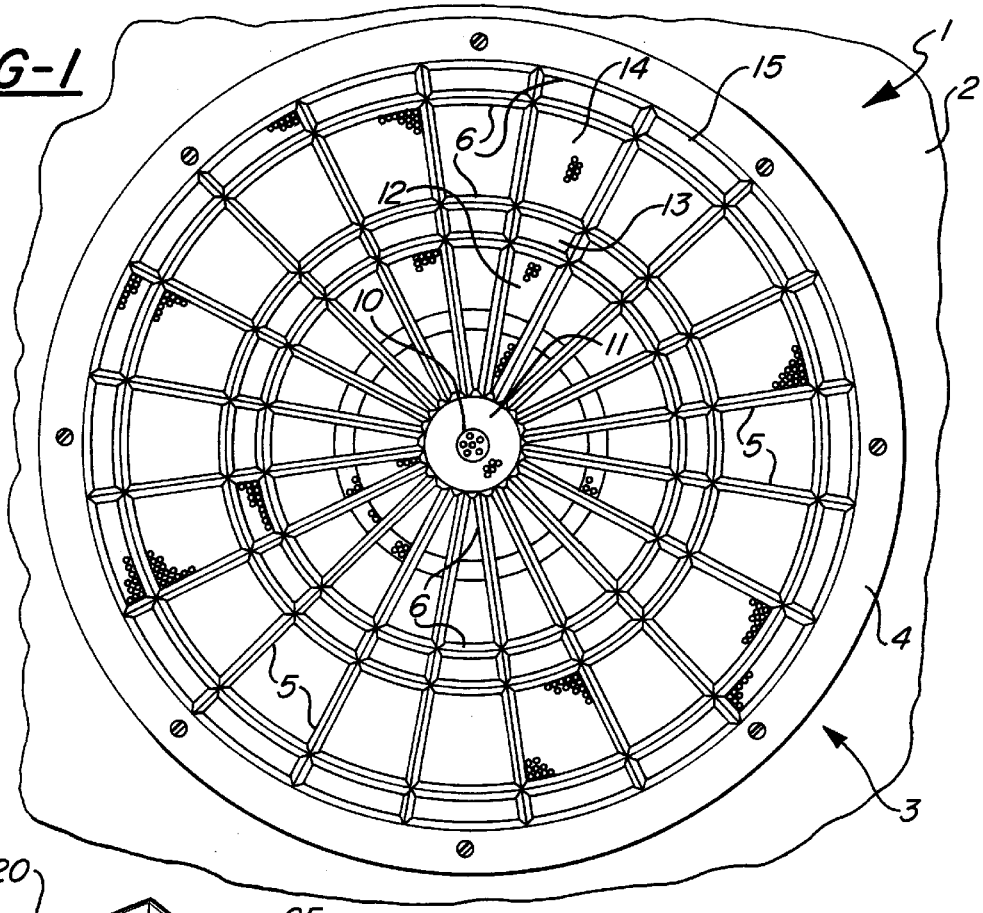
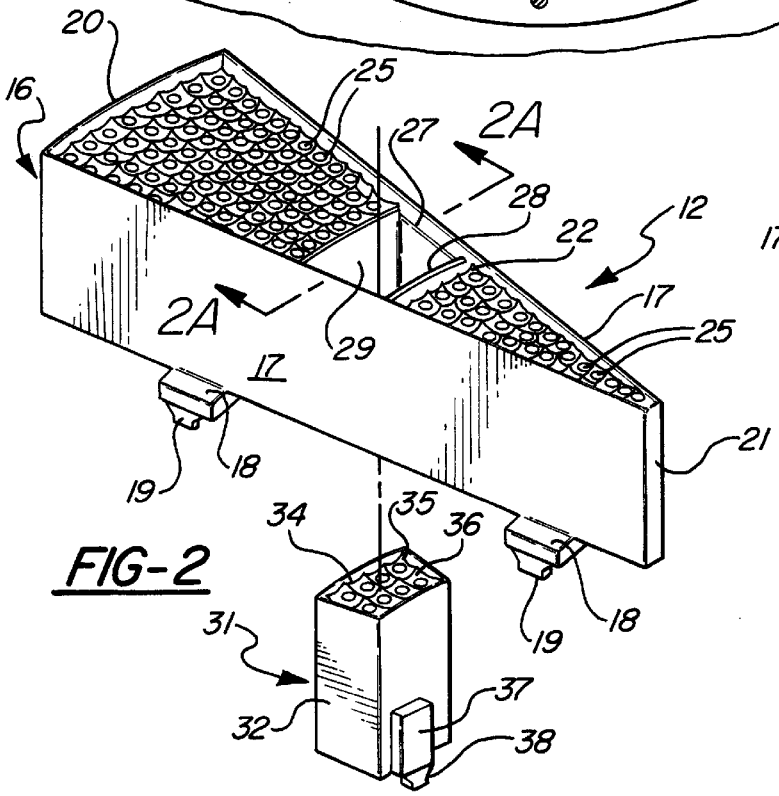
FIG-2
FIG-2A
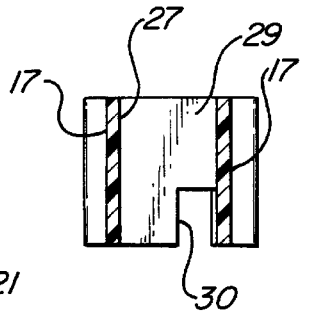

TARGET CONSTRUCTION

This invention relates to a target construction for use with a dart game of the kind in which darts thrown at the target displace individual target segments in response to which scoring is effected electronically.

BACKGROUND OF THE INVENTION

Conventional targets of the kind used in dart games are of two kinds: one has a fiberboard body on the surface of which is a spider dividing the body into a plurality of sectors each of which has a score value, and the other of which has a base on which is supported a frame having radial and annular ribs defining spaces in which are accommodated displaceable segments having score values. The segments, when displaced, activate an electronic circuit for effecting scoring.

The traditional dart target, whether of fiberboard or incorporating displaceable segments, has a cylindrical inner bullseye at its center and a concentric ring constituting an outer bullseye encircling the inner bullseye, a plurality of pie-shaped segments arranged circumferentially about the outer bullseye ring, a plurality of arcuate triples segments encircling the pie-shaped segments, a plurality of larger arcuate segments encircling the triples segments, and a plurality of arcuate outer segments forming a doubles scoring bed at the periphery of the target.

Recently, fiberboard targets have been modified to incorporate an additional, or fourth, annular scoring bed which is located substantially midway between the outer bullseye and the triples bed and generally occupying the center portion of the pie segment. This additional scoring bed easily may be included in the fiberboard body target simply by providing the overlying spider frame with two additional concentric wire rings which define the additional scoring bed for the target. However, such additional scoring bed has not been provided for those targets having electronic scoring apparatus actuated by displacement of individual target segments.

The principal objective of the present invention is to provide a target of the kind having individual, displaceable segments responsive to being struck by a thrown dart to actuate an electronic scoring mechanism and to incorporate in such a target an additional or fourth scoring bed without the need to replace or modify the conventional spider.

SUMMARY OF THE INVENTION

A target constructed in accordance with the invention has a base on which an electrical matrix switch is secured, the matrix switch underlying a resilient pad. Overlying the resilient pad and secured to the base is a circular frame or spider composed of a plurality of interconnected radial and annular ribs which together form a plurality of radially and circumferentially extending spaces. Accommodated in each of the spaces formed by the frame is a target segment which is restrained by the frame from movement in the direction away from the base, but which is capable of movement toward the base when it is struck by a thrown dart. Each of the individual segments has a plurality of projections that extend from the segment toward the base a distance sufficient to bear lightly on or have minimum clearance from the resilient pad and which, when displaced, close selected ones of the matrix switches and generate an electrical signal which, in turn, actuates a scoring mechanism.

The target segments within the frame or spider together form a circular target face. The target face comprises a cylindrical inner bullseye; a first ring which encircles the inner bullseye and forms an outer bullseye; a plurality of circumferentially spaced pie-shaped segments; a plurality of circumferentially spaced, arcuate segments which together form a triples scoring bed; a plurality of circumferentially spaced, larger arcuate, intermediate segments which together form an annular scoring bed, and a plurality of arcuate segments encircling the intermediate segment and forming a third scoring bed known as a doubles scoring bed.

The target of this invention also has a fourth scoring bed comprising, within each of the pie-shaped segments, a cavity occupied by an insert, the combined inserts forming an annulus.

Each insert is displaceable toward the target base when it is struck by a dart and is movable through a distance toward the base sufficient to compress the resilient pad and the matrix switch to actuate an electronic scoring mechanism. Each insert is restrained against movement from an at rest position in a direction away from the base so as to avoid being separated from the remainder of the target. However, each insert and its associated pie segment are so constructed that each segment may move toward the target base independently of its insert a distance sufficient to actuate the scoring mechanism associated with each segment, but without actuating the scoring mechanism associated with the insert, and vice-versa.

A target constructed in accordance with the invention has a face provided with four separate and independently operable scoring beds, namely, the conventional triples bed, the conventional intermediate bed, the conventional peripheral doubles bed, and the additional or fourth bed between the radially inner and outer ends of the pie-shaped segments.

THE DRAWINGS

A target constructed in accordance with the preferred embodiment of the invention is illustrated in the accompanying drawings wherein:

FIG. 1 is an elevational view of a target constructed in accordance with the invention;

FIG. 2 is an exploded, enlarged, perspective view of one of the pie-shaped segments and its associated insert;

FIG. 2A is a sectional view taken on the line 2A—2A of FIG. 2;

THE PREFERRED EMBODIMENT

Figure 3:
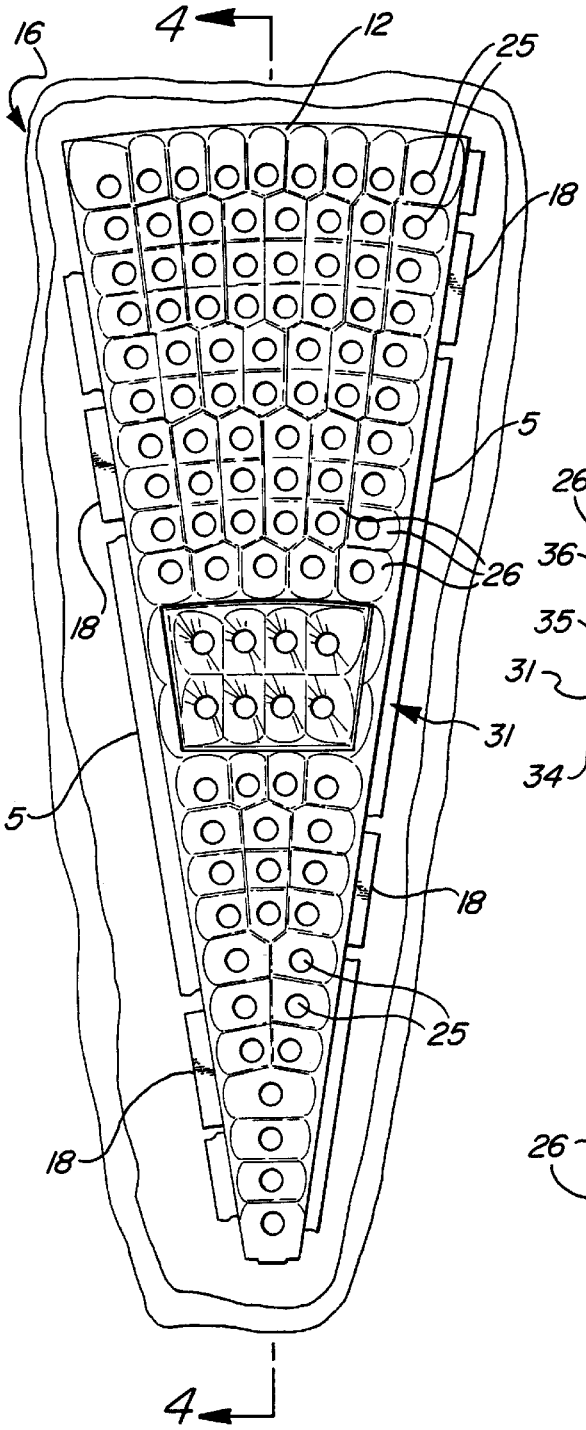
FIG. 3 is an enlarged, elevational view of one of the pie-shaped target segments with a removable insert accommodated in a cavity therein.

A target constructed in accordance with the presently preferred embodiment of the invention is illustrated in FIG. 1 and designated generally by the reference character 1. The target is adapted to be mounted on a wood or other base 2 (FIGS. 1 and 4). overlying the base and secured thereto by screws is a target frame or spider 3 comprising an annular flange 4 to which is integrally joined a plurality of radial ribs 5. The ribs 5 are uniformly circumferentially spaced from one another. The target frame also includes a plurality of concentric ribs 6 joined to the ribs 5 and radially spaced about the center of the target frame.

Overlying the base 2 and underlying the target 1 is a matrix switch 7 of known construction having a plurality of pads or contacts 8 and connected wiring (not shown) leading to an electronic scoring mechanism (not shown). Overlying the matrix switch 7 is an elastromeric biasing pad 9. The pad underlies the target frame 3.

The ribs 5 and 6 form a plurality of radially and circumferentially spaced spaces in each of which is accommodated a target segment. At the center of the target is a cylindrical, inner bullseye segment 10 that is encircled by an outer bullseye segment ring 11. Radially outward of the bullseye ring 11 is a plurality of pie-shaped segments 12, a plurality of triples scoring segments 13, a plurality of substantially trapezoidal intermediate scoring segments 14 and a plurality of peripheral, doubles scoring segments 15.

Figure 4:
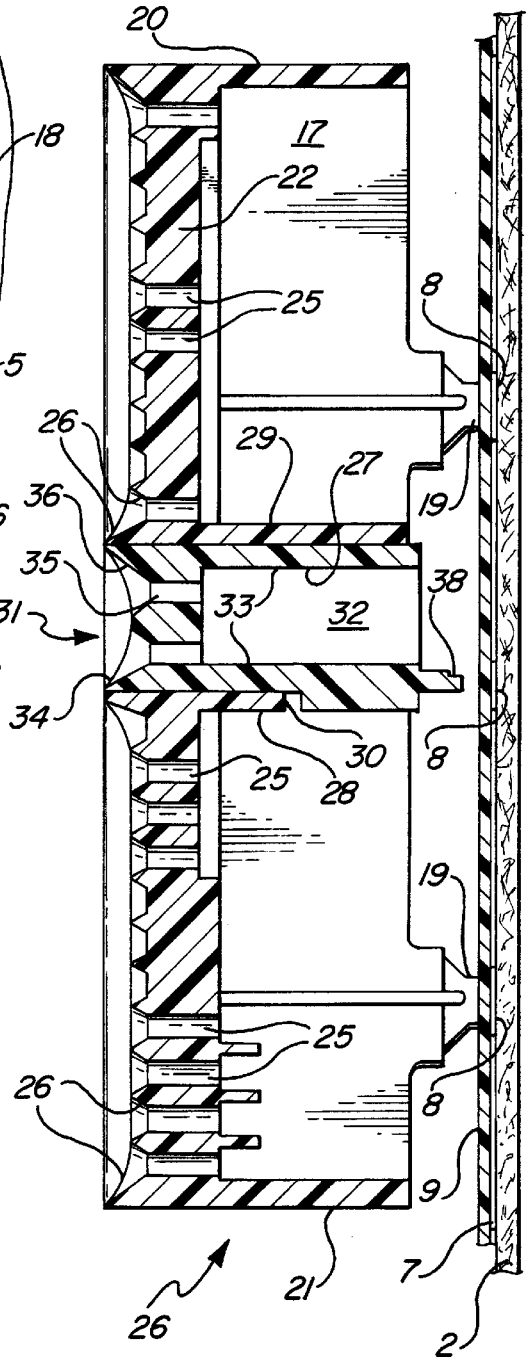
FIG. 4 is a sectional view taken on the line 4—4 of FIG. 3.

A typical pie-shaped segment 12 is shown in FIGS. 2–4 and comprises a hollow body 16 having along its opposite sides 17 laterally projecting ledges 18 which underlie adjacent spider ribs 5 thereby enabling unrestricted movement of the segment in a direction toward the base 2, but restricting movement of the segment in the opposite direction.

The outer bullseye ring 11 and the other segments 13, 14, and 15 are provided with ledges similar to the ledges 18 which react in a similar manner with the ribs 5 and 6 and enable unrestricted movement of the outer bullseye ring and such other segments in a direction toward the base 2, but restrict movement in the opposite direction. The cylindrical inner bullseye segment 10 is restrained against movement away from the base 2 in the manner disclosed in Brejcha U.S. Pat. No. 4,586,716. The manner in which the segments 12–15 are restrained against movement in a direction away from the base 2 corresponds to that disclosed in De Vale et al U.S. Pat. No. 4,836,556. The disclosures of such patents are incorporated herein by reference.

Each of the ledges 18 includes a switch actuating projection 19 which extends in the direction of the base 2. Similar projections are provided for each of the other segments 10, 11, and 13–15. The projections associated with each segment normally bear against the elastromeric pad 9 and overlie associated switch contacts 8 so that, when any segment is displaced toward the base 2 in response to being struck by a thrown dart, the projections 19 will compress the pad 9 and enable a circuit to be completed between the appropriate contacts 8 to effect actuation of the electronic scoring mechanism. When the energy generated by a thrown dart is dissipated, the pad 9 will restore the displaced segment to its original, at rest condition.

As thus far described, the target 1 corresponds in all respects to the target disclosed in the De Vale et al patent. The principal differences in the target construction disclosed herein and that disclosed in the De Vale et al patent are incorporated in the pie-shaped segments 12.

The body 16 of each pie-shaped segment 12 is molded from a suitable plastic material and has opposite side walls 17 and end walls 20 and 21. These walls are spanned by an outer face member 22 having a plurality of cylindrical openings 25 therein for the removable accommodation of the tip of a dart, the outer surface of the face member having inwardly tapering surfaces 26 which lead into the opening 25. Similar openings 25 are included in all of the other segments. The body 16 has a cavity 27 therein formed in part by the opposite side walls 17 of the body and in part by two arcuate walls 28 and 29 which span the opposite walls 17. The walls 28 and 29 not only participate in the formation of the arcuate cavity, but also reinforce the sides 17 of the body 16 so as to eliminate or greatly minimize the tendency of such walls following molding of the segment 12 to shrink and bow inwardly or toward one another as the molded material cools. Such reinforcement and consequent avoidance of bowing of the side walls of the segment overcome problems associated with the ability of the segment to slide smoothly within its space in the target frame and maintain accurate axial alignment or registration with the center of the matrix switch pads.

Each of the walls 28 and 29 has a linearly extending slot 30 therein. The slots 30 are staggered so that the slot 30 in the wall 29 is adjacent one side wall 17 and the slot 30 in the wall 28 is adjacent the opposite side wall 17 of the body. (See FIG. 2A.)

Slideably accommodated in the cavity 27 is an insert 31 having side walls 32 which taper to match the taper of the body side walls 17 and opposite end walls 33 which confront the walls 28 and 29 of the cavity 27. The insert 31 has an outer face 34 provided with openings 35 and tapered surfaces 36 which correspond to the openings 25 and the surfaces 26, respectively, of the face of the segment body 16.

Each of the walls 33 of the insert 31 has a protrusion 37 which snugly, but slideably, is accommodated in the associated slot 30 of the cavity walls 28 and 29. The slots 30 and the protrusions 37 constitute interleaved guides which preclude substantially all relative movement between the insert 31 and the body 20 except movement of the insert toward and away from the target base 2. Engagement between the protrusions 37 and the base of the respective slots limits movement of the insert in a direction away from the base 2.

Figure 5:
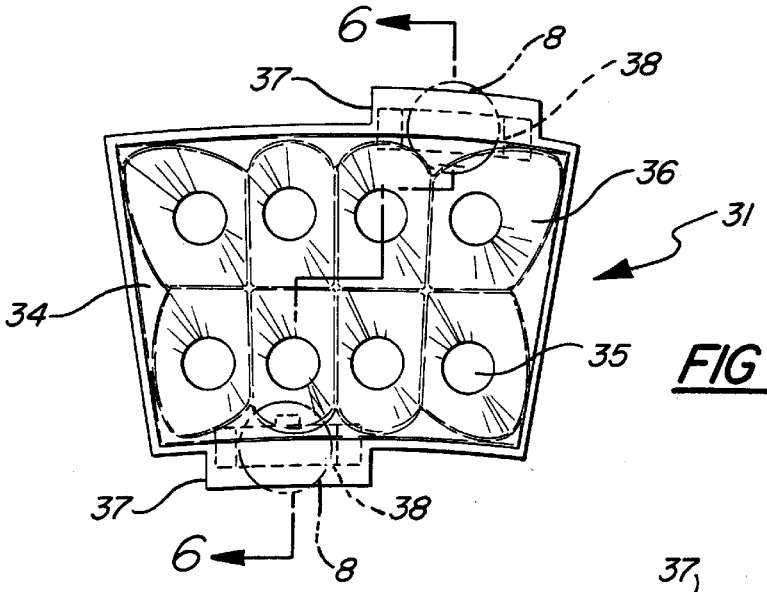
FIG. 5 is an enlarged, front elevational view of the insert.
Figure 6:
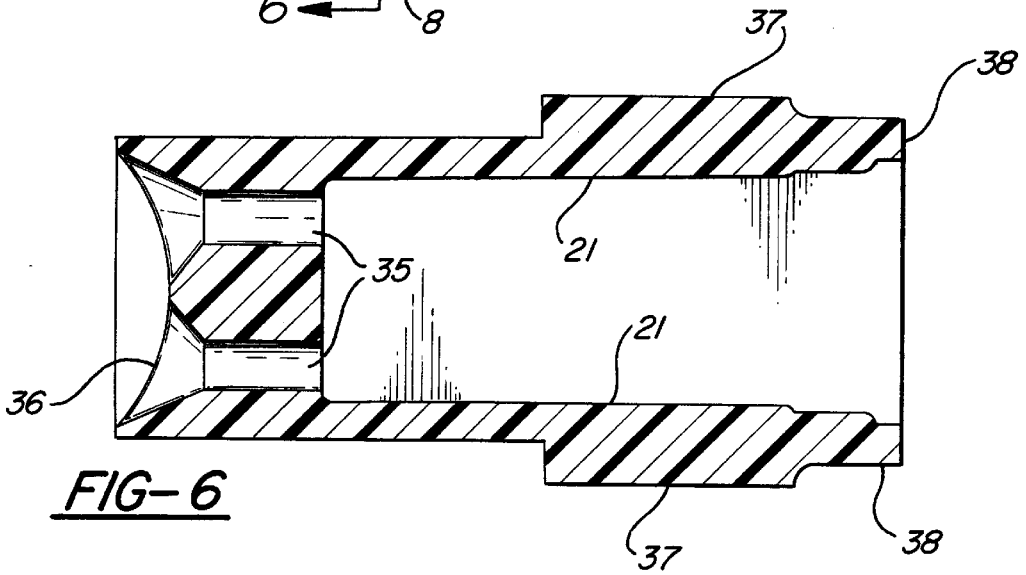
FIG. 6 is a sectional view taken on the line 6—6 of FIG. 5.
Figure 7:
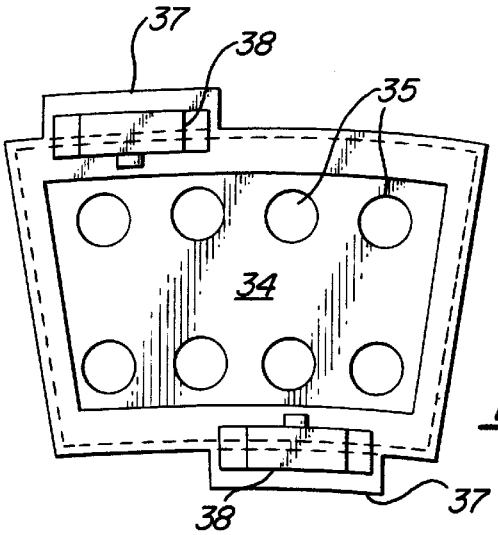
FIG. 7 is a rear elevational view of the insert.

Each of the protrusions 37 has a projection 38. The projections 38 register with electrical contacts 8 which are adapted to be activated in response to movement of the insert 31 an appropriate distance toward the target base 2. As is best shown in FIG. 5, the projections 38 are staggered and the associated contacts 8 are correspondingly staggered. This enables the contacts 8 to be spaced sufficiently far from one another to provide stability and avoid any likelihood of bridging. The protrusions 37 also are staggered which has the effect of minimizing any tendency on the part of the insert to rock left to right or right to left (as viewed in FIG. 5) when it is struck by a dart. Thus, any tendency on the part of the insert to bind in its cavity 27 is overcome. The interleaving of the guide slots and protrusions also minimizes face-to-face contact between the inserts and the walls 28 and 29, thereby reducing friction between the insert and the associated segment.

As is best shown in FIG. 4, the combined height of the insert 31 and its projections 38 is less than the combined height of the segment body 16 and its projections 19. The difference in height is sufficient to enable the segment body 16 to be displaced a distance sufficient for its projections 19 to activate the scoring mechanism associated with the relevant switch contacts 8, but without enabling the projections 38 associated with the insert 31 to actuate the associated switch contacts 8. The difference in the combined heights preferably is at least as great as the thickness of the pad 7.

To condition the target for use the matrix switch 7 is applied to one face of the base 8, and the pad 9 is placed in overlying relation with the matrix switch 7. The inserts 31 are fitted into the cavities 27 of the associated pie-shaped segments 12 so that the face 34 of each insert faces outwardly and bridges the gap formed by the cavity in the face 22 of the segment 12. The remaining segments 10, 11, and 13–15 are fitted into their respective spaces in the frame 3 and the latter is secured in overlying relation to the base 2 in overlying relation with the parts 7 and 9. The wiring (not shown) associated with the switch contacts 8 is secured to a source (not shown) of electrical power and to a scoring mechanism (not shown) as is conventional. The target 1 then is supported in a substantially vertical position so that it is in a position to receive thrown darts.

Whenever a thrown dart impacts any one of the segments 10–15, such segment will be displaced rearwardly or toward the base 2 and the switch actuating projections associated with such segment will cause the appropriate switch contacts to actuate the scoring mechanism.

If the segment struck by the dart is one of the pie-shaped segments 12, and if the dart strikes such segment in a zone other than that occupied by an insert 31, the segment 12 will be displaced to effect actuation of the switches associated with the projections 19. Depending on the position occupied by the insert at the time its associated segment 12 is struck by a dart, the insert may or may not be displaced toward the target base 2 until such time as the protrusions 37 are engaged by the insert walls 28 and 29 which confront the free ends of the protrusions.

Because of the difference in the combined overall heights of the segment 12 and the insert 31, displacement of the segment 12 will not enable the projections 38 of the insert 31 to activate the associated switch contacts 8.

When a thrown dart strikes an insert 31, only the insert is displaced toward the target base 2 a distance sufficient to enable the projections 38 to activate the associated switch contacts 8 and actuate the appropriate scoring mechanism. Since there is no restriction on the movement of the insert 31 in the direction of the target base 2, the projections 38 may move freely the distance required to activate the associated switch contacts 8 without any corresponding movement of the segment 12.

Because each insert 31 is wholly confined by the segment 12 in which it is mounted, the frame or spider 3 of the kind shown in the De Vale et al patent may be used with the target disclosed in that patent and the target disclosed herein without modification.

The disclosed embodiment is representative of a presently preferred form of the invention, but is intended to be illustrative rather than definitive thereof. The invention is defined in the claims.

I claim:

1. A target segment comprising a body member having an exposed, outer face and a cavity extending through said face inward of said body member; an insert member having an exposed outer face and occupying said cavity, said insert member being slideable in said cavity in opposite directions; interleaved guide means on said members for restricting substantially all relative movement therebetween except in said opposite directions; and a plurality of projections on each of said members extending in the same direction beyond said body member and terminating in free ends, the combined height of said insert member and its projections being less than the combined height of said body member and its projections, said guide means enabling unrestricted movement of said insert member relative to said body member in the direction that said projections extend and restricting movement of said insert member relative to said body member in the opposite direction.

2. The target segment according to claim 1 wherein said interleaved guide means comprises at least one slot in one of said members and at least one protrusion on the other of said members, said protrusion being slideably accommodated in said slot.

3. The target segment according to claim 1 wherein said insert has at its outer surface an exposed face corresponding to that of said body member.

4. The target segment according to claim 1 wherein said body member is hollow and has side and end walls bridged by said face, said cavity being defined in part by said side walls and in part by spaced, parallel walls spanning the side walls of said body member.

5. The target segment according to claim 4 wherein said face of said body member includes a plurality of uniform openings therein.

6. The target segment according to claim 4 wherein said interleaved guide means comprises a pair of slots in said parallel walls and a pair of protrusions at opposite sides of said insert member, said protrusions being slideably accommodated in said slots.

7. The target segment according to claim 6 wherein the slots are staggered relative to one another and the protrusions are correspondingly staggered.

8. The target segment according to claim 1 wherein said insert member is hollow and has side and end walls bridged by said outer face of said insert member.

9. The target segment according to claim 8 wherein said outer face of said insert member has a plurality of openings therein.

10. The target segment according to claim 1 wherein said insert member has a pair of said projections offset from one another.

11. A target for intercepting moving missiles, said target comprising a base; a frame composed of a plurality of ribs joined to one another and defining spaces therebetween; means securing said frame to said base in overlying relation therewith; a plurality of individual target segments occupying said spaces and together forming a circular target face having a center, each of said segments being movable toward and away from said base; retaining means reacting between said segments and said frame for restricting movement of said segments in a direction away from said base, corresponding ones of said segments comprising a body having a cavity therein at a uniform distance from said center thereby defining an annulus; an insert slideably accommodated in each of said cavities, each of said inserts having an exposed outer face spanning the associated cavity thereby avoiding gaps in said target face; cooperable guide means carried by each of said corresponding segments and its associated insert for restricting substantially all movement of each such insert relative to its associated corresponding segment except movements toward and away from said base; and a plurality of projections carried by each of said corresponding segments and each of said inserts and extending beyond the associated segment body in a direction towards said base, each of said inserts and its projections having a combined height less than the combined height of the associated segment body and its projections, said guide means enabling movement of each of said segments toward said base a predetermined distance without causing corresponding movement of the associated insert, said guide means enabling unrestricted movement of said inserts toward said base without causing corresponding movement of the associated segment.

12. The target according to claim 11 including a resilient pad of selected thickness interposed between said base and each of said segments in a position to be engaged and compressed by the projections of said segments and said inserts, the difference between the combined heights of said segments and said inserts corresponding substantially to the thickness of said pad.

13. The target according to claim 12 wherein said predetermined distance corresponds substantially to the thickness of said pad.

14. The target according to claim 12 wherein said guide means comprises a pair of slots in said segment and a corresponding pair of protrusions on said insert slideably accommodated in said slots.

15. The target according to claim 14 wherein said slots are staggered and said protrusions are correspondingly staggered.

16. The target according to claim 12 including electrical switching means interposed between said base and said pad, said switching means comprising a plurality of electrically conductive members engageable by the respective projections of said segments and said inserts.

17. The target according to claim 16 wherein the projections of each of said inserts are staggered and wherein the conductive members engageable by their respective projections of each of said inserts are correspondingly staggered.

18. A target construction comprising a base; a plurality of conductive members secured to said base at one side thereof; a resilient pad overlying said base and said conductive members; a frame having a plurality of circumferentially spaced ribs radiating from a center and a plurality of radially spaced, concentric ribs joined to said radial ribs, the spacings between said radial ribs and said concentric ribs defining spaces for the accommodation of target segments corresponding to the shapes of said spaces, said target segments together defining a target face having a bullseye at said center and concentric scoring annuli spaced radially from said center, corresponding ones of said segments each having a uniform recess therein uniformly spaced from said center; a plurality of inserts accommodated in said recesses and forming an additional scoring annulus concentric with said annuli, each of said inserts being reciprocable toward and away from said base; means reacting between each of said segments and adjacent ones of said ribs for limiting movement of said segments away from said base; means reacting between said inserts and the associated segment for limiting movement of said inserts away from said base, each of said segments and each of said inserts being capable of unrestricted movement towards said base; and guide means reacting between each of said inserts and the associated segment for restricting all movement of each of said inserts relative to the associated segment except for said reciprocable movements, said guide means enabling movement of each segment toward said base a predetermined distance independently of the associated insert.

19. The target according to claim 18 wherein said predetermined distance corresponds substantially to the thickness of said pad.

20. The target according to claim 18 wherein said guide means comprises a pair of protrusions carried by each of said inserts and extending into slots formed in each of the associated segments.

* * * * *